US012590536B2

(12) United States Patent
Ignova et al.

(10) Patent No.: US 12,590,536 B2
(45) Date of Patent: Mar. 31, 2026

(54) SYSTEMS AND METHODS FOR SURFACE SUPERVISION OF A DOWNHOLE TOOL

(71) Applicant: Schlumberger Technology Corporation, Sugar Land, TX (US)

(72) Inventors: Maja Ignova, Cheltenham (GB); Katharine Mantle, Cheltenham (GB); Ekaterina Brovko, Cheltenham (GB); Michael Oswald, Lakewood, CO (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/883,050

(22) Filed: Sep. 12, 2024

(65) Prior Publication Data

US 2026/0071539 A1 Mar. 12, 2026

(51) Int. Cl.

| | |
|---|---|
| ***E21B 47/18*** | (2012.01) |
| ***E21B 7/04*** | (2006.01) |
| ***E21B 44/00*** | (2006.01) |
| ***E21B 47/022*** | (2012.01) |

(52) U.S. Cl.

CPC ..... *E21B 47/18* (2013.01); *E21B 7/04* (2013.01); *E21B 44/00* (2013.01); *E21B 47/022* (2013.01)

(58) Field of Classification Search

CPC ... E21B 7/04; E21B 7/06; E21B 44/00; E21B 44/005; E21B 45/00; E21B 47/022

See application file for complete search history.

(56) References Cited

U.S. PATENT DOCUMENTS

| | | | | |
|---|---|---|---|---|
| 7,000,710 | B1 * | 2/2006 | Umbach | E21B 7/046 175/45 |
| 8,783,382 | B2 * | 7/2014 | Ignova | E21B 7/04 702/9 |
| 9,043,152 | B2 * | 5/2015 | Schuberth | E21B 47/022 175/45 |
| 9,587,478 | B2 * | 3/2017 | Moran | E21B 44/00 |
| 9,945,222 | B2 * | 4/2018 | Sugiura | E21B 44/005 |
| 10,612,307 | B2 * | 4/2020 | Summers | E21B 7/10 |
| 10,883,346 | B2 * | 1/2021 | Enkababian | E21B 49/00 |
| 10,989,038 | B1 * | 4/2021 | Shen | E21B 44/06 |
| 10,995,604 | B2 * | 5/2021 | Hornblower | E21B 7/04 |
| 11,408,228 | B2 * | 8/2022 | Groover | E21B 47/013 |
| 11,421,521 | B1 * | 8/2022 | Dontsova | E21B 44/02 |
| 11,970,929 | B2 * | 4/2024 | Gillan | E21B 7/04 |
| 12,065,923 | B2 * | 8/2024 | Li | E21B 49/003 |
| 12,086,515 | B2 * | 9/2024 | Guillot | G06F 30/27 |
| 12,106,028 | B2 * | 10/2024 | Ozbek | E21B 41/00 |

(Continued)

FOREIGN PATENT DOCUMENTS

| | | | | |
|---|---|---|---|---|
| GB | 2264562 A | * | 9/1993 | E21B 45/00 |
| WO | WO-2021236877 A1 | * | 11/2021 | E21B 41/00 |

*Primary Examiner* — Jennifer H Gay

(74) *Attorney, Agent, or Firm* — Jeffrey D. Frantz

(57) ABSTRACT

A system may obtain azimuth and inclination measurements from a downhole tool in a downhole environment. A system may obtain a downhole ROP and downhole DLS from a downhole control unit. A system may determine a corrected DLS demand based at least partially on a ratio of downhole ROP and surface ROP. A system may transmit a DLS demand setting to the downhole tool based at least partially on the corrected DLS demand and the downhole ROP. A system may drill at least a portion of a borehole with the downhole tool based at least partially on the corrected DLS demand.

10 Claims, 7 Drawing Sheets

(56) References Cited

U.S. PATENT DOCUMENTS

| | | | | |
|---|---|---|---|---|
| 2004/0222019 | A1 | 11/2004 | Estes | |
| 2012/0316787 | A1* | 12/2012 | Moran | E21B 44/00 702/9 |
| 2013/0041586 | A1* | 2/2013 | Schuberth | E21B 47/022 702/6 |
| 2015/0211352 | A1 | 7/2015 | Sugiura | |
| 2016/0160628 | A1* | 6/2016 | Sugiura | E21B 7/06 700/275 |
| 2017/0306702 | A1* | 10/2017 | Summers | E21B 7/10 |
| 2018/0363444 | A1* | 12/2018 | Hornblower | E21B 45/00 |
| 2018/0371883 | A1* | 12/2018 | Enkababian | G01V 5/12 |
| 2022/0003107 | A1 | 1/2022 | Samuel | |
| 2022/0049554 | A1* | 2/2022 | Groover | E21B 47/013 |
| 2022/0170360 | A1* | 6/2022 | Li | E21B 49/003 |
| 2023/0186000 | A1* | 6/2023 | Ozbek | E21B 41/00 175/61 |
| 2023/0195952 | A1* | 6/2023 | Guillot | E21B 49/00 175/24 |
| 2023/0279765 | A1* | 9/2023 | Gillan | E21B 47/024 175/70 |
| 2024/0026769 | A1 | 1/2024 | Chen | |
| 2024/0352800 | A1* | 10/2024 | Ignova | E21B 7/06 |
| 2024/0352802 | A1* | 10/2024 | Mantle | E21B 7/064 |
| 2024/0352843 | A1* | 10/2024 | Tasoujian | E21B 7/04 |
| 2025/0305403 | A1* | 10/2025 | Johnston | G06Q 10/063 |
| 2025/0305404 | A1* | 10/2025 | Jamieson | E21B 44/00 |

* cited by examiner

SYSTEMS AND METHODS FOR SURFACE SUPERVISION OF A DOWNHOLE TOOL

BACKGROUND

For drilling of a borehole, directional drilling allows creation of a non-linear borehole or a linear borehole through varying earth formations. Directional drilling units conventionally communicate with the surface to transmit status information and/or receive instructions through lengthy pulse communications. Reduction of communication time can increase the uptime of a drilling system.

SUMMARY

In some aspects, the techniques described herein relate to a method of controlling a downhole tool, the method including: obtaining azimuth and inclination measurements from a downhole tool in a downhole environment; obtaining a downhole ROP and downhole DLS from a downhole control unit; determining a corrected DLS demand based at least partially on a ratio of downhole ROP and surface ROP; transmitting a DLS demand setting to the downhole tool based at least partially on the corrected DLS demand and the downhole ROP; and drilling at least a portion of a borehole with the downhole tool based at least partially on the corrected DLS demand.

In some aspects, the techniques described herein relate to a method of controlling a downhole tool, the method including: obtaining orientation measurements from a downhole tool in a downhole environment; obtaining a downhole ROP and downhole DLS from a downhole control unit; comparing the orientation measurements to a threshold value; based at least partially on the orientation measurements being outside the threshold value, conducting fault detection of a bottomhole assembly (BHA); determining a corrected DLS demand based at least partially on a ratio of downhole ROP and surface ROP; and transmitting a DLS demand setting to the downhole tool based at least partially on the corrected DLS demand and the downhole ROP; and drilling at least a portion of a borehole with the downhole tool based at least partially on a corrected DLS demand.

In some aspects, the techniques described herein relate to a system for drilling a borehole, the system including: a bottomhole assembly (BHA) including: a downhole control unit, a directional steering tool, and a drill bit; and a surface control unit configured to: obtain azimuth and inclination measurements from a downhole tool in a downhole environment, obtain a downhole ROP and downhole DLS from the downhole control unit, determine a corrected DLS demand based at least partially on a ratio of downhole ROP and surface ROP, and transmit a DLS demand setting to the downhole tool based at least partially on the corrected DLS demand and the downhole ROP.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and aspects of embodiments of the disclosure will be set forth in the description which follows, and in part will be obvious from the description, or may be learned by the practice of such embodiments. The features and aspects of such embodiments may be realized and obtained by means of the instruments and combinations particularly pointed out in the appended claims. These and other features will become more fully apparent from the following description and appended claims or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, non-schematic drawings should be considered as being to scale for some embodiments of the present disclosure, but not to scale for other embodiments contemplated herein. Understanding that the drawings depict some example embodiments, the embodiments will be described and explained with additional specificity and detail through the use of the accompanying drawings in which.

DETAILED DESCRIPTION

Figure 1:
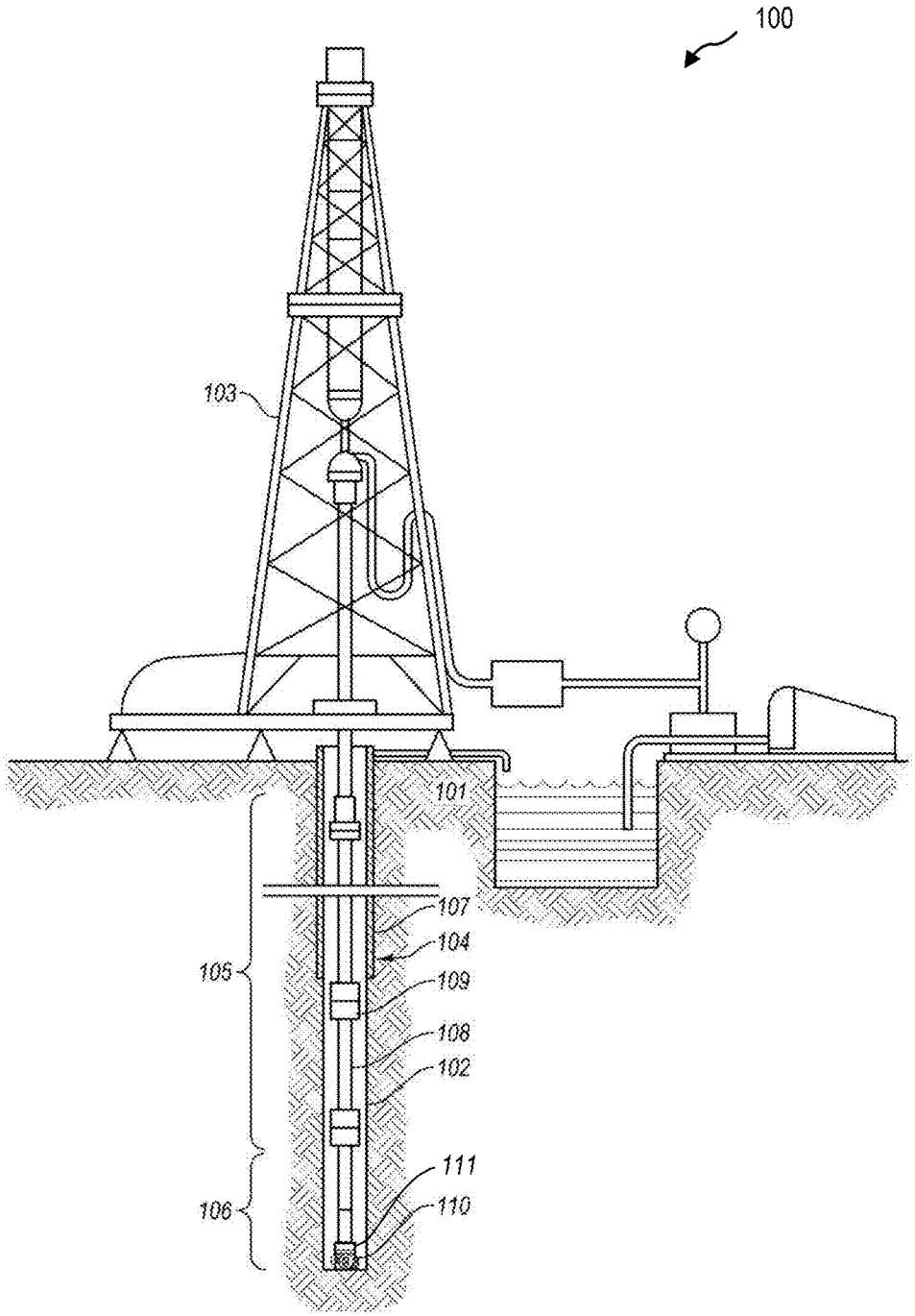
FIG. 1 illustrates a drilling system and downhole environment, according to some embodiments of the present disclosure.

Embodiments of the present disclosure generally relate to devices, systems, and methods for controlling a downhole tool in a downhole environment. In some embodiments, methods and systems, according to the present disclosure, include a control unit in the downhole environment receiving or detecting a communication to control at least a portion of a bottomhole assembly. In some embodiments, downlink communications to adjust drilling parameters of the downhole tool(s) slow or stop drilling operations for 5 to 30 minutes. Simplifying and/or reducing the number of downlink communications and the duration of the downlink communications from a surface controller can save significant time and money on a drill site.

In some embodiments, automated drilling routines based on one or more pre-determined stages or a pre-determined well plan can limit downhole communications and increase uptime of the drilling system. However, downhole environments are variable and the effects on the drilling system and components of the drilling system can be unexpected. Furthermore, communication with a bottomhole assembly (BHA) or other downhole components of the drill string can present a challenge when hundreds or thousands of meters from the surface controls.

In some embodiments, an automated drilling routine automatically adjusts one or more operating parameter of a downhole component, such as a directional steering tool, turbine, or mud motor to change a rate of penetration (ROP) of a drill bit or a direction and/or radius of curvature of the borehole during drilling. For example, an automated drilling routine may target a pre-determined azimuth and/or inclination for the borehole being drilled. The directional steering tool may actuate steering pads or other features to urge the drill bit in the direction of the target azimuth and/or inclination. By acting over a period of time, a gradual curve can be created in the borehole to meet the target azimuth and/or inclination before a target location is reached and/or a target distance is drilled.

In some embodiments, the directional steering tool and/or other downhole components can measure the rotational orientation of the directional steering tool and/or other downhole components but may be uninformed of the longitudinal position of the BHA in the borehole and the actual ROP (and longitudinal speed) of the BHA and/or drill string through the formation. In the event that the directional steering tool and/or other downhole components are not changing orientation when expected (i.e., not moving through a curve), the automated drilling routine may attempt to compensate for the difference between the targeted changes and the measured changes by adjusting (e.g., increasing) a targeted dogleg severity (DLS) and/or ROP.

More particularly, some automated drilling routines include setting or changing DLS based on time and progress toward a target value or target location. The longitudinal progress through a planned stage or well plan is, in some embodiments, calculate (and not measured) in the downhole environment by a fixed estimate of the ROP stored locally on the downhole tool ("downhole ROP"). In some embodiments, the downhole ROP is stored on a surface control device to limit additional communication with the downhole tool(s). In the event that the ROP as measured by advancement of drill pipe or other segments of the drill string at the surface ("surface ROP") is not matching the downhole ROP, the downhole tool can steer the bit and/or BHA with a DLS that provides the wrong curvature and/or misses a target location. In a particular example, if the surface ROP is 50% of the downhole ROP, an automated drilling routine actuating a directional steering tool based on the downhole ROP may create an actual DLS (e.g., 2°/10 m) that is double the planned DLS (1°/10 m) according to the stage and/or well plan. In another particular example, if the surface ROP is 200% of the downhole ROP, an automated drilling routine actuating a directional steering tool based on the downhole ROP may create an actual DLS (e.g., 0.5°/10 m) that is half the planned DLS (1°/10 m) according to the stage and/or well plan.

If the drill string is not advancing (e.g., during connection of a stand, idling, rotating off-bottom, or reaming), the drilling system can continue ramping the DLS and ROP progressive more and more, causing a runaway DLS. In some examples, the directional steering tool and/or other downhole components can erroneously determine the BHA is not effectively turning through the formation when the drilling system is, in actuality, not drilling at all. In a particular instance, transmitting a conventional downlink communication to change the automated drilling routine settings and/or reset values can require a 25-minute sequence of downlink communications. In another particular instance, changing the downhole ROP of a conventional BHA requires more steps and longer communications than changing a demanded DLS value. In some embodiments, according to the present disclosure, a downlink communication includes a corrected DLS demand based on a ratio of the known downhole ROP (as stored locally on the BHA) and a measured surface ROP to effectuate a desired actual DLS. In such embodiments, the downlink communication including the corrected DLS demand is shorter and/or more reliable than a series of downlink communications to change the downhole ROP and the DLS.

In some embodiments, a drilling rig or other component of the drilling system at surface transmits a downlink communication to the control unit. In at least one embodiment, the downlink communication is a rotations-per-minute (RPM) pulse. For example, an RPM pulse can allow a downlink communication when drilling fluid (e.g., mud) flow rate and/or pressure is unreliable. In at least one embodiment, the single downlink communication is a mud pulse. For example, a mud pulse can allow a downlink communication when an RPM pulse is unreliable.

In some embodiments, such as when ratio of the known downhole ROP and a measured surface ROP ("ROP ratio") determine a corrected DLS will saturate the directional steering tool (e.g., request the directional steering tool actuate a steering pad at or beyond 100% of the actuation range), systems and methods according to the present disclosure additionally provide instructions to change an ROP of the drilling system.

For example, an ROP ratio of 0.5 (e.g., the downhole ROP is half the surface ROP) may generate a corrected DLS demand that is double the planned DLS. In other words, when the actual ROP is faster than planned, the directional steering tool will apply a greater force to steer the BHA faster through a curved portion of the well plan. In such an instance, doubling the steering of the directional steering tool may saturate the directional steering tool. In some embodiments, systems and methods according to the present disclosure include determining both a corrected DLS demand (e.g., 100% steering) to be communicated downhole to the BHA and an ROP demand to adjust the surface ROP to effectuate the desired trajectory. In some embodiments, the ROP ratio is further used for fault detection when measured drilling orientation and dynamics values exceed threshold values.

FIG. 1 illustrates an embodiment of a drilling system and downhole environment. FIG. 1 shows one example of a drilling system 100 for drilling an earth formation 101 to form a borehole 102. The drilling system 100 includes a drill rig 103 used to turn a drilling assembly 104 which extends downward into the borehole 102. The drilling assembly 104 may include a drill string 105 and a bottomhole assembly (BHA) 106 attached to the downhole end of the drill string 105. Where the drilling system 100 is used for drilling formation, a drill bit 110 can be included at the downhole end of the BHA 106.

The drill string 105 may include several joints of drill pipe 108 connected end-to-end through tool joints 109. The drill string 105 transmits drilling fluid through a central bore and can transmit rotational power from the drill rig 103 to the BHA 106. In some embodiments, the drill string 105 may further include additional components such as subs, pup joints, etc. The drill pipe 108 provides a hydraulic passage through which drilling fluid 111 is pumped from the surface. The drilling fluid 111 discharges through selected-size nozzles, jets, or other orifices in the bit 110 for the purposes of cooling the bit 110 and cutting structures thereon, for lifting cuttings out of the borehole 102 as it is being drilled, and for preventing the collapse of the borehole 102. The drilling fluid 111 carries drill solids including drill fines, drill cuttings, and other swarf from the borehole 102 to the surface. The drill solids can include components from the earth formation 101, the drilling assembly 104 itself, from other man-made components (e.g., plugs, lost tools/components, etc.), or combinations thereof.

The BHA 106 may include the bit 110 or other components. An example BHA 106 may include additional or other components (e.g., coupled between to the drill string 105 and/or the bit 110). Examples of additional BHA components include drill collars, stabilizers, measurement-while-drilling (MWD) tools, logging-while-drilling (LWD) tools, downhole motors, underreamers, directional steering tools, section mills, hydraulic disconnects, jars, vibration dampening tools, other components, or combinations of the foregoing.

In general, the drilling system 100 may include other drilling components and accessories, such as special valves (e.g., kelly cocks, blowout preventers, safety valves, centrifuges, shaker tables, and rheometers). Additional components included in the drilling system 100 may be considered a part of the surface system (e.g., drill rig 103, drilling assembly 104, drill string 105, or a part of the BHA 106, depending on their locations and/or use in the drilling system 100).

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits, roller cone bits, impregnated bits, or coring bits. In other embodiments, the bit 110 may be a mill used for removing metal, composite, elastomer, other materials downhole, or combinations thereof. For instance, the bit 110 may be used with a whipstock to mill into casing 107 lining the borehole 102. The bit 110 may also be a junk mill used to mill away tools, plugs, cement, other materials within the borehole 102, or combinations thereof. Swarf or other cuttings formed by use of a mill may be lifted to surface by the drilling fluid 111 or may be allowed to fall downhole. The conditions of the equipment of the drilling system 100, the formation 101, the borehole 102, the drilling fluid 111, or other part of the wellsite can change during operations.

Figure 2:
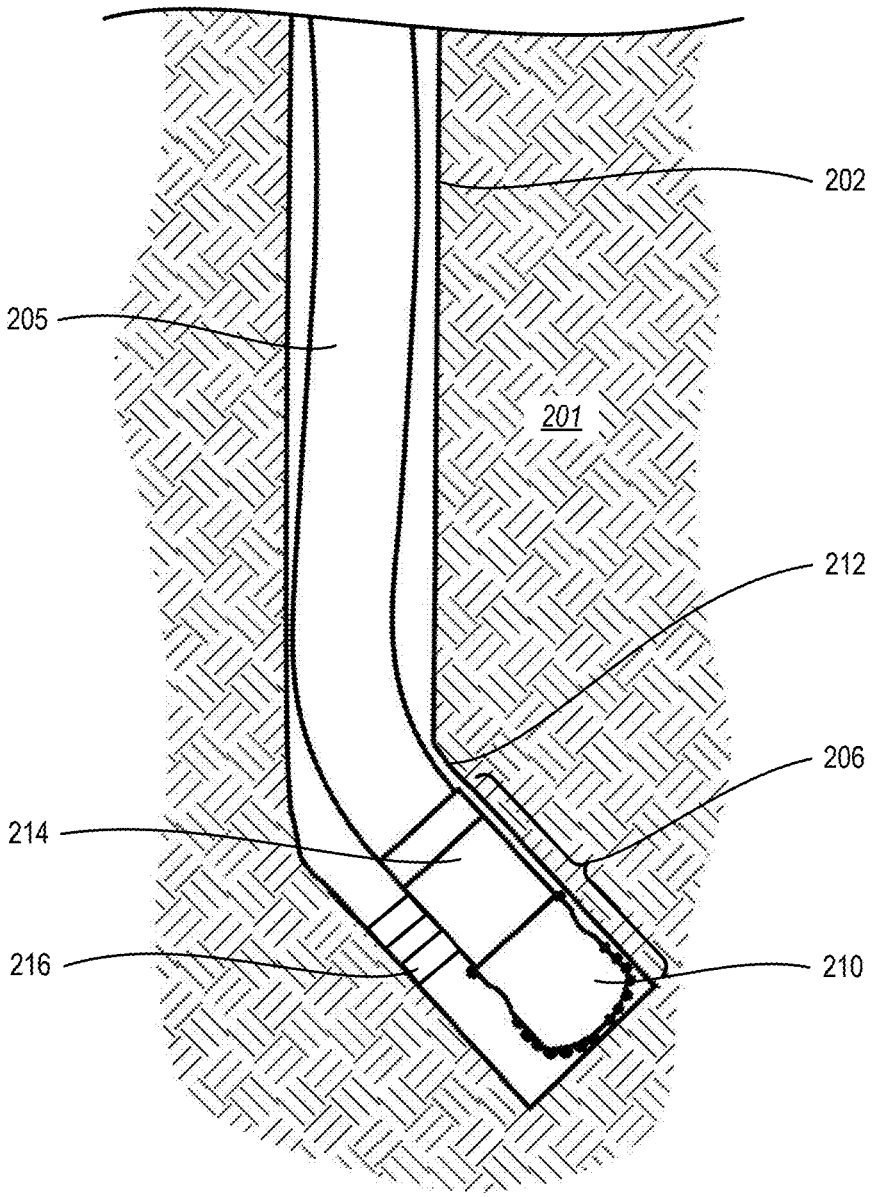
FIG. 2 is a side view of a downhole environment in which a bottomhole assembly (BHA) and drill string steer the bit to create a curve of a borehole, according to some embodiments of the present disclosure.

In some embodiments, the BHA 106 includes one or more biasing units that allow an operator to steer the bit 110 relative to the earth formation 101 as the drilling assembly 104 rotates in the borehole 102. For example, FIG. 2 is a side view of an embodiment of a downhole environment in which a BHA 206 and drill string 205 steer the bit 210 to create a curve of a borehole 202.

In some embodiments, a portion of the BHA 206 and/or drill string 205 contacts a radially inward surface 212 of the borehole 202 as the BHA 206 and drill string 205 follow the curve. In some embodiments, when the BHA 206 and drill string 205 contact the formation 201 of the borehole surface, the BHA 206 and drill string 205 experience damage from the formation 201. In some embodiments, when the BHA 206 and drill string 205 contact the formation 201 of the borehole surface, the BHA 206 and drill string 205 experience drag, in the longitudinal direction and/or the rotational direction, placing additional strain on the drilling system and components thereof. Precise control of steering the BHA 206 and the bit 210 with a directional steering tool 214 allows the drilling system to limit and/or prevent damage to the BHA 206 and drill string 205 in non-linear boreholes 202. In some embodiments, automated drilling routines are controlled from the downhole tool that relies upon a downhole target ROP approximated at the start of a drilling run. If the actual ROP deviates due to drilling conditions, the automated drilling routines or automated control of the directional steering tool can produce too high or too low of a DLS when attempting to meet a target.

In some embodiments, a directional steering tool 214 is a discrete steering tool that is coupled to a drill bit 210. In some embodiments, the directional steering tool 214 is the drill bit with an integrated biasing element or steering element. For example, a directional steering tool 214 includes at least one actuatable biasing element 216 configured to actuate radially outward from a rotational axis of the BHA 206 and drill string 205. As the BHA 206 and drill string 205 rotate, the actuatable biasing element 216 is actuated between a closed position and an open position to selectively apply a lateral force to the borehole wall. The drill bit 210 is urged in an opposing lateral direction to steer the drill bit 210 and the direction of the borehole 202.

In some embodiments, an MWD unit allows for measurements of a plurality of operating conditions, environmental conditions, fluid measurements, or other status information regarding the performance and/or condition of the downhole tool and the downhole environment in which the downhole tool is operating. In some embodiments, the MWD unit measures and/or records directional information of the downhole tool. In some examples, the MWD unit includes accelerometers and/or magnetometers to measure the inclination and azimuth of the borehole at the measured location. In some embodiments, the MWD unit includes survey gyroscopes that allow directional and/or movement information, such as inclination, azimuth, velocity, and other values. In some embodiments, the MWD unit records the directional measurements. In some embodiments, the MWD unit transmits the measurements to a system and/or operator at the surface.

In some embodiments, the MWD unit measures and/or records drilling mechanics information. In some embodiments, the drilling mechanics information includes a rotational speed (e.g., RPM) of the drill string and/or drill bit; variation (vibration) in the rotational speed; amplitude, frequency, and mode of vibrations of the drill string; downhole temperature; torque on bit; weight on bit; mud flow volume; other drilling mechanics information; and combinations thereof. In some embodiments, the MWD unit records the drilling mechanics information or reports the drilling mechanics information to a control unit in the BHA 206. In some embodiments, the MWD unit transmits the drilling mechanics information to a system and/or operator at the surface.

Figure 3:
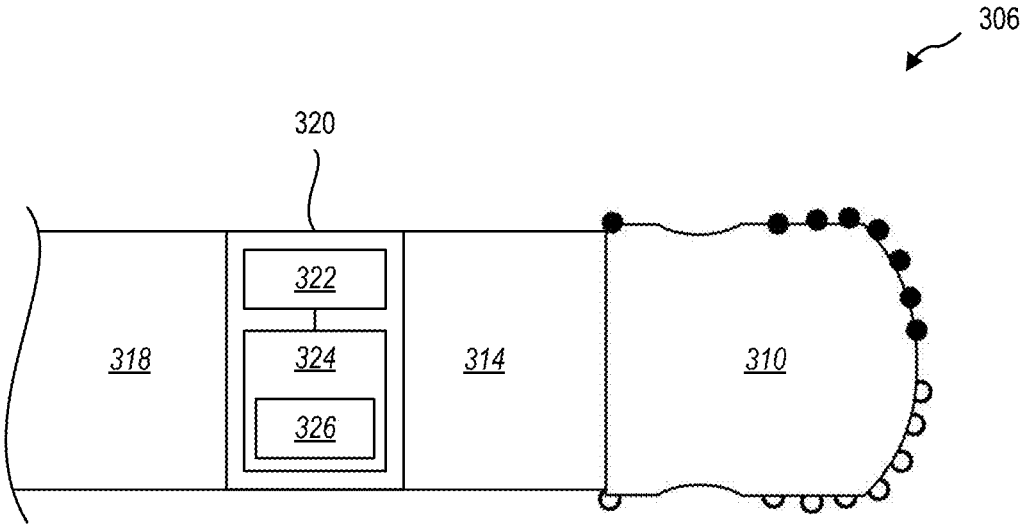
FIG. 3 is a system diagram of a BHA including a control unit, according to some embodiments of the present disclosure.

In some embodiments, the BHA includes a control unit configured to receive one or more of directional information, operating conditions, environmental conditions, fluid measurements, drilling mechanics information, or other status information, as illustrated in the embodiment of FIG. 3. In some embodiments, the control unit 320 is in data communication with at least one sensor (e.g., an MWD 318 including one or more sensors) and a directional steering tool 314. In some embodiments, the control unit 320 is integrated with the MWD 318 and/or the directional steering tool 314. The control unit 320 includes a processor 322 and a hardware storage device 324 in data communication with the processor 322. The hardware storage device 324 has instructions stored thereon that, when executed by the processor 322, cause the BHA 306 to perform at least a portion of any method described herein.

In some embodiments, the hardware storage device 324 has a plurality of stages and/or well plan 326 stored thereon. In some embodiments, the well plan 326 is loaded to the hardware storage device 324 at the surface of the drilling system prior to running the BHA 306 (including the control unit 320) downhole. In some embodiments, the well plan 326 includes a plurality of stages of the well plan 326. The control unit 320 obtains at least one of the directional information, operating conditions, environmental conditions, fluid measurements, drilling mechanics information, or other status information from one or more sensors of the BHA 306. In at least one example, the sensors are in or part of the MWD 318.

A formation measurement is, in some examples, a measurement of at least one property of the formation through which the BHA 306 is drilling or otherwise located. For example, a formation measurement includes a formation fluid composition, a formation solids composition (e.g., geochemistry), a formation hardness, a formation porosity, a formation fluid flow rate, a formation homogeneity, etc. In some embodiments, the formation measurement is made by one or more sensors of the BHA 306. In some embodiments, the formation measurement is made by sensors in the drill bit 310. In some embodiments, the formation measurement is made by sensors in the MWD 318. In some embodiments, the formation measurement is made by sensors in the directional steering tool 314.

An environmental measurement is, in some examples, a measurement of at least one property of the downhole environment that may or may not be related to the formation through which the BHA 306 drills or is located. For example, an environmental measurement may include temperature, pressure, or other measurements that are not formation measurements but inform the drilling system of downhole conditions. In some embodiments, the environmental measurement is made by one or more sensors of the BHA 306. In some embodiments, the environmental measurement is made by sensors in the drill bit 310. In some embodiments, the environmental measurement is made by sensors in the MWD 318. In some embodiments, the environmental measurement is made by sensors in the directional steering tool 314.

In some embodiments, the BHA 306 uses the plurality of stages and/or well plan 326 stored locally on the BHA 306 to determine target values, including target ROP and target DLS, of automated drilling routines of the stages and/or well plan.

Figure 4:
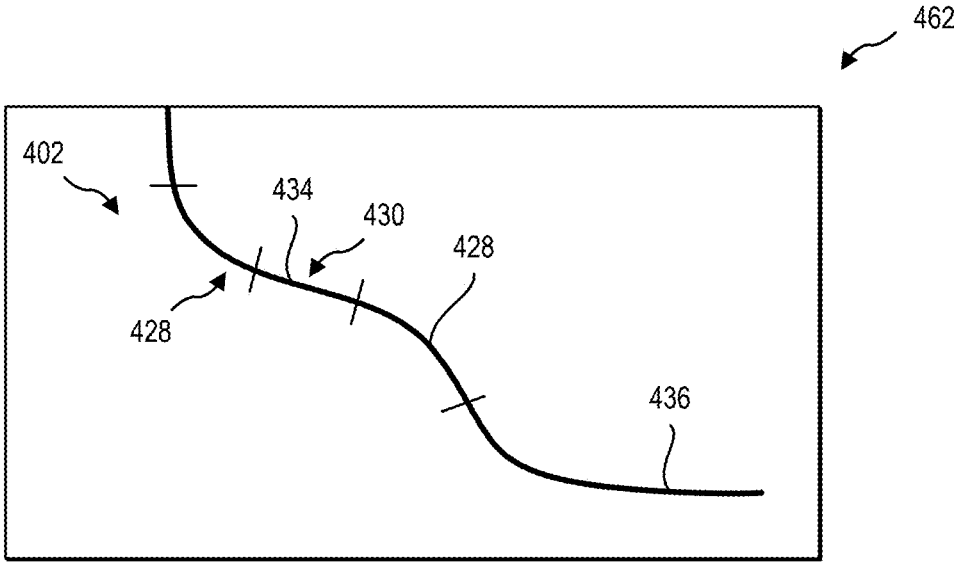
FIG. 4 is a schematic representation of an embodiment of a well plan stored on a hardware storage device of a control unit and/or BHA, according to some embodiments of the present disclosure.

FIG. 4 is a schematic representation of an embodiment of a well plan 462 stored on a hardware storage device of a control unit and/or BHA described herein. In some embodiments, the well plan 462 includes a plurality of stages with transitions therebetween. For example, the well plan 462 may include a curved stage 428 and/or a linear stage 430. In some embodiments, the well plan 462 includes a plurality of curved stages 428 and linear stages 430. In some embodiments, the well plan 462 includes at least one vertical stage. In some embodiments, the well plan 462 includes a landing stage 436. The directional steering tool and other components of the drill string directs the BHA and drill bit through the formation according to the inclination, azimuth, dogleg severity (DLS), rate of penetration, axial length along the stage, and other parameters of the well plan 462.

A curved stage 428 is any stage of the well plan 462 in which at least one of the inclination and the azimuth of the borehole 402 changes along a length of the stage. While the schematic illustration of FIG. 4 depicts an embodiment of a curved stage 428 with a change in inclination along a length of the curved stage 428, it should be understood that in some embodiments of a curved stage the inclination is substantially constant and the azimuth of the borehole 402 changes. In some embodiments, both the inclination and the azimuth of the borehole 402 changes in the curved stage 428.

A linear stage 430 is any stage of the well plan 462 in which the inclination and azimuth of the borehole 402 remains constant along the length of the stage. In some embodiments, a linear stage 430 is a vertical stage of the well plan 462 in which the inclination is substantially vertical relative to a direction of gravity. For example, a vertical stage may be an initial stage from the surface. In some embodiments, a linear stage 430 of the well plan 462 is a directional stage 434 in which the inclination and azimuth are substantially constant, while the inclination is non-vertical, creating a lateral net movement of the borehole 402 along the length of the directional stage 434 relative to the direction of gravity.

In some embodiments, the well plan 462 includes a landing stage 436. In some embodiments, the landing stage 436 is a curved stage in which the borehole 402 attains a substantially horizontal orientation relative to the direction of gravity. In some embodiments, the landing stage 436 is a final stage of the well plan 462.

In some embodiments, the inclination and/or azimuth are measured dynamically in the downhole environment by one or more components of the BHA. However, determining an accurate and/or precise ROP of the bit and/or BHA through the formation material in the downhole environment is a challenge. In some embodiments, the auto curve and/or hold inclination and azimuth (HIA) systems of the drilling system use a provided downhole ROP value that is stored locally in the BHA to determine the amount and direction of steering to achieve target values. Downlink communications to change the downhole ROP can require a series of downlink communications that interrupt drilling operations for extended periods of time.

Figure 5:
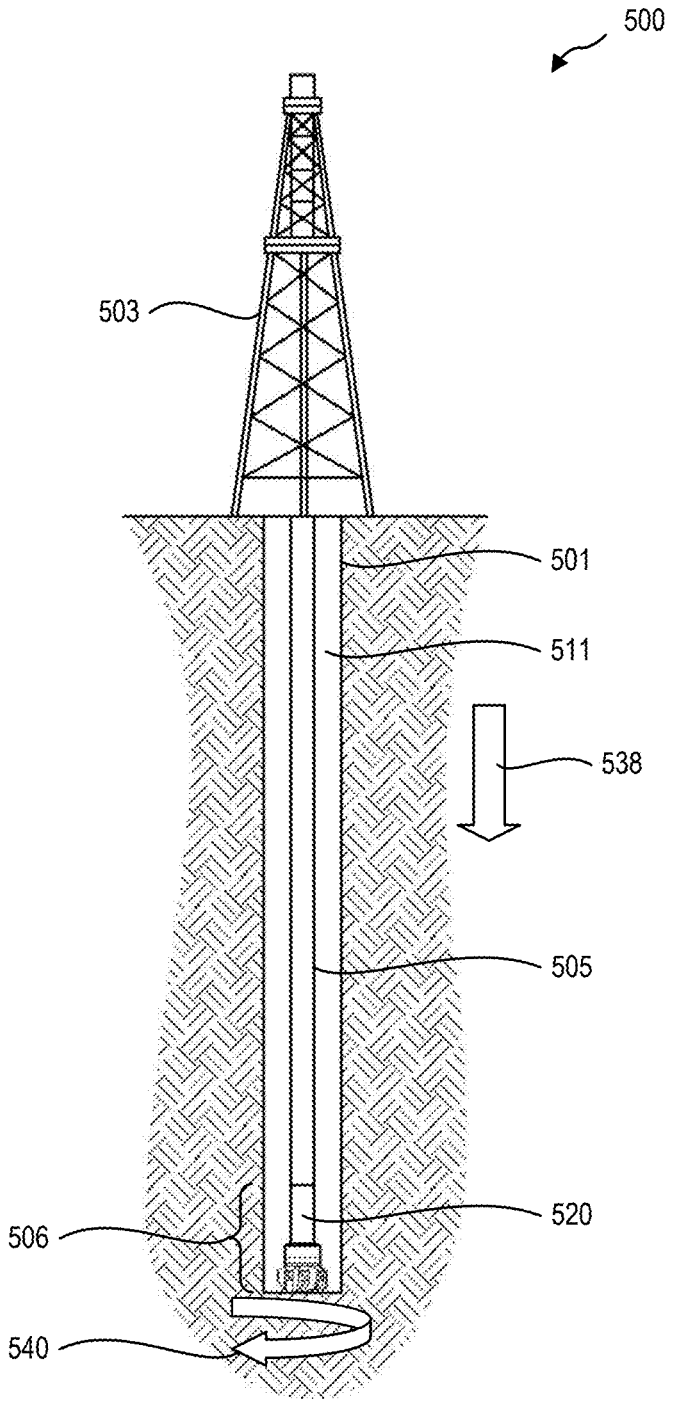
FIG. 5 is an embodiment of a downlink communications from a surface of a drilling system to a BHA, according to some embodiments of the present disclosure.

FIG. 5 is an embodiment of a downlink communications from a surface of a drilling system 500 to a BHA 506. In some embodiments, the drilling system 500 can communicate downhole with the control unit 520 and/or BHA 506 by mud pulses 538. For example, a drilling fluid 511 or mud flows downward through the drill string 505 to the control unit 520 and/or BHA 506 as described herein. By varying a flow rate and/or a fluid pressure of the drilling fluid 511, the drilling rig 503 at the surface of the drilling system 500 can transmit instructions to the control unit 520 and/or BHA 506. In a conventional system, the downlink communication includes a plurality of mud pulses 538 in the downhole direction, where each mud pulse 538 is of varying duration to communicate or select settings in the BHA 506. In some examples, the borehole 501 and/or drill string 505 can be long, introducing fluidic drag into the mud pulses 538, requiring each mud pulse to be a minute or longer. A sequence of mud pulses 538, therefore, can take several minutes or longer to communicate a relatively simple change to BHA settings.

In some embodiments, the drilling system 500 can communicate downhole with the control unit 520 and/or BHA 506 by RPM pulses 540. For example, the drilling rig 503 applies a torque to change the revolutions per minute (RPM) of the drill string 505 to communicate with the control unit 520 and/or BHA 506. By varying an RPM of the drill string 505 through a series of changes or at a particular RPM, the drilling rig 503 at the surface of the drilling system 500 can transmit instructions to the control unit 520 and/or BHA 506. In a conventional system, the downlink communication includes a plurality of RPM pulses 540, where each RPM pulses 540 is of varying duration and/or RPM to communicate or select settings in the BHA 506. In some examples, the borehole 501 and/or drill string 505 can be long, introducing significant torsional elasticity, fluidic drag, friction with a borehole wall and other variables into the communication of the transmission of the RPM pulse 540 in the downhole direction. The delay and/or noise (e.g., torsional oscillations) in the transmission of the RPM pulses 540 can require each RPM pulse 540 to be a minute or longer to effectively communicate the signal to the control unit 520 and/or BHA 506. A sequence of RPM pulses 540, therefore, can take several minutes or longer to communicate a relatively simple change to BHA settings.

Figure 6:
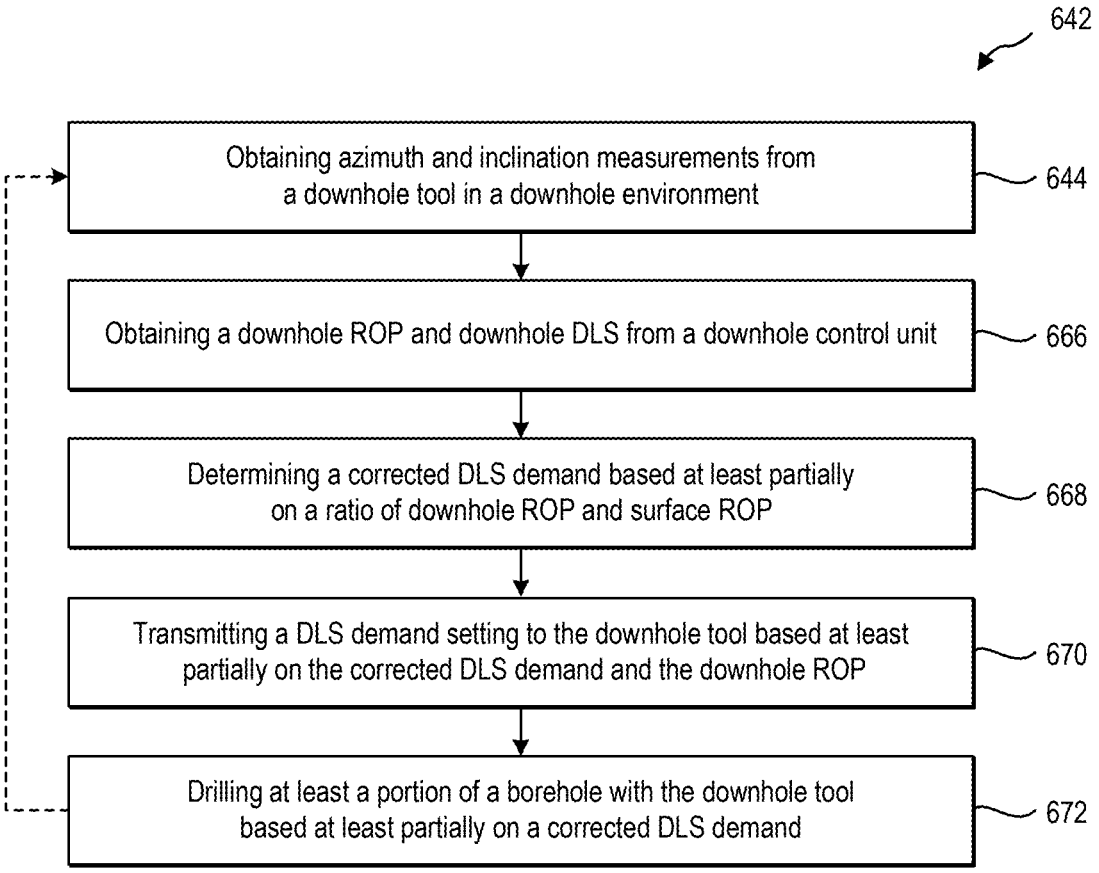
FIG. 6 is a flowchart illustrating a method of controlling a downhole tool, according to some embodiments of the present disclosure.

FIG. 6 is a flowchart illustrating an embodiment of a method 642 of surface control of a BHA in a downhole environment. In some embodiments, the method 642 includes obtaining azimuth and inclination measurements from a downhole tool in a downhole environment at 644. As described herein, the azimuth and inclination measurements may be obtained from an MWD or other sensors of the downhole tool or components in communication with the downhole tool. The method 642 further includes obtaining a downhole ROP and downhole DLS from a downhole control unit at 666. In some embodiments, the downhole ROP is a fixed value stored locally on a hardware storage device of the downhole control unit and/or BHA. In some embodiments, the downhole DLS is determined by the downhole control unit and/or BHA based on the measured changes in azimuth and inclination over time relative to the downhole ROP.

As described herein, the downhole ROP may not reflect the actual ROP of the drilling system, and the method 642 further includes determining a corrected DLS demand based at least partially on a ratio of downhole ROP and surface ROP (ROP ratio) at 668. In at least one embodiment, the corrected DLS demand is downhole DLS multiplied by the ROP ratio. In one example, the ROP ratio is 1.0 (e.g., the downhole ROP is the actual ROP) and a corrected DLS demand is the same as the downhole ROP. In other words, when the BHA is actually advancing at the planned ROP, the downhole DLS is correct. In another example, the ROP ratio is 0.5 (e.g., the downhole ROP is half of the actual surface ROP) and a measured downhole DLS is 2°/10 m. The corrected DLS demand to be communicated to the control unit and/or directional steering device is 1°/10 m, as the ROP ratio indicates the BHA is advancing twice as fast as the downhole ROP estimates.

In some embodiments, the determining a corrected DLS demand based at least partially on the ROP ratio further includes obtaining or determining a saturation percentage of the directional steering tool. For example, a saturation percentage is the percentage of available actuation distance or range used by the directional steering tool to achieve a current or demanded DLS. In some embodiments, obtaining or determining a saturation percentage of the directional steering tool includes measuring a saturation status. For example, the saturation status may be a binary value reporting whether the directional steering tool is saturated or not. The corrected DLS demand may be based at least partially on the saturation percentage and/or saturation status. For example, a corrected DLS demand may saturate the directional steering tool and include an instruction to change the surface ROP to achieve a desired actual DLS when the directional steering tool is saturated.

The method 642 includes transmitting a corrected DLS demand setting to the downhole tool based at least partially on the corrected DLS demand and the downhole ROP at 670. In some embodiments, the corrected DLS demand is communicated downhole by a downlink communication, as described herein. For example, the downlink communication may be a mud pulse communication. In another example, the downlink communication may be an RPM pulse communication.

In some embodiments, the method 642 further includes drilling at least a portion of a borehole with the downhole tool based at least partially on a corrected DLS demand at 672. The method may optionally include repeating at least a portion of the method 642 after drilling the portion of the borehole to ensure the BHA remains on target.

In some embodiments, surface monitoring and controlling the downhole tool includes determining a state or fault of the downhole tool. For example, in some embodiments, one or more of the inclination, azimuth, DLS, tool face, or other status measurements are outside of a threshold target range.

Figure 7:
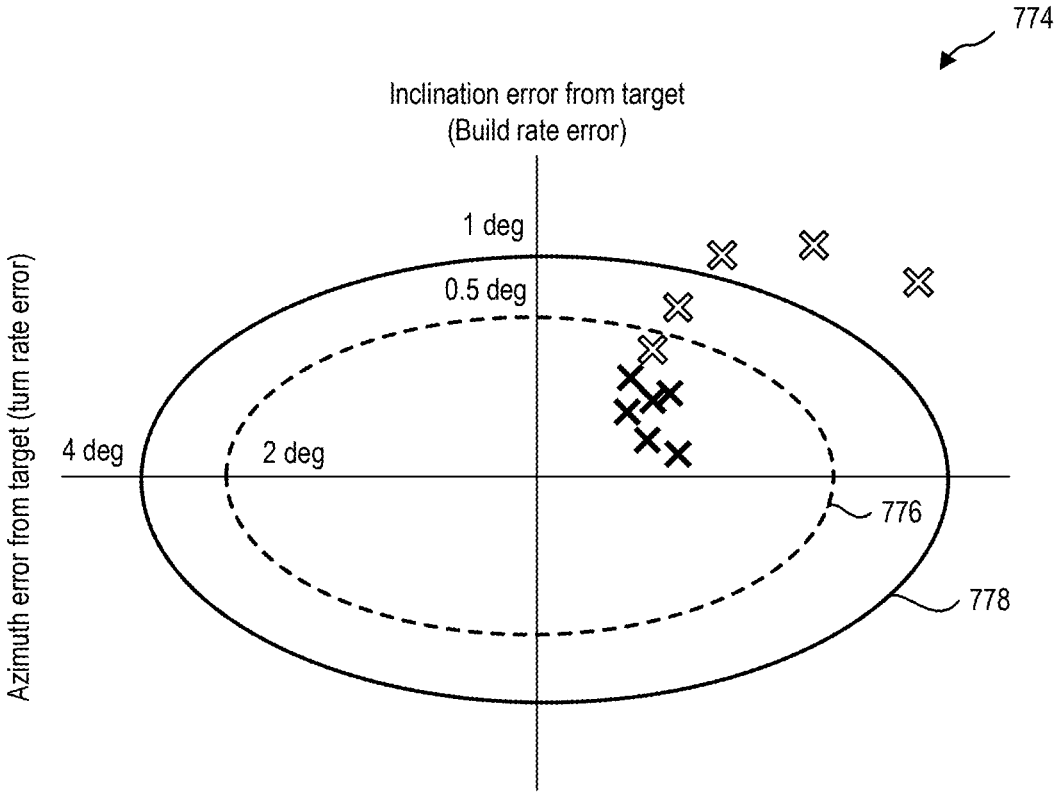
FIG. 7 is a graph of measurements of inclination and azimuth deviation from a target value of a stage and/or well plan.

FIG. 7 is a graph 774 of measurements of inclination and azimuth deviation from a target value of the stage and/or well plan. In some embodiments, the target value ranges for the inclination and azimuth are the same. For example, the tolerated deviation between the measured inclination and azimuth and the target value for the inclination and azimuth may be 2°. In other embodiments, the target value ranges for the inclination and azimuth are different. For example, the tolerated deviation between the measured inclination and the target inclination may be 2°, and the tolerated deviation between the measured azimuth and the target azimuth may be 1°.

In the illustrated embodiment of FIG. 7, a plurality of threshold values of the target ranges allow for different levels of action, notification, or intervention. For example, the first target value range 776 for the inclination allows up to a 2° deviation from the target value, and the first target value range 776 for the azimuth allows up to a 0.5° deviation from the target value (with a proportional limit in combination of the inclination and azimuth errors). In some embodiments, a measurement within the first target range is considered a normal or good state, and the system continues with the existing operations. In some embodiments, a measurement outside of the first target range 776 prompts action from the system, including a notification to an operator and/or autonomous device control. In some embodiments, the second target value range 778 for the inclination allows up to a 4° deviation from the target value, and the second target value range 778 for the azimuth allows up to a 1.0° deviation from the target value (with a proportional limit in combination of the inclination and azimuth errors). In some embodiments, a measurement outside of the second target range 778 prompts a second action from the system, such as a notification to an operator, an automated intervention, a stoppage of at least a portion of the drilling system, or combination thereof.

In some embodiments, a measurement outside of the threshold values for the target range triggers a fault detection of the system. For example, a notification to an operator may include an intervention suggestion and/or an autonomous intervention may require a cause of the fault to remedy before action can be taken.

Figure 8:
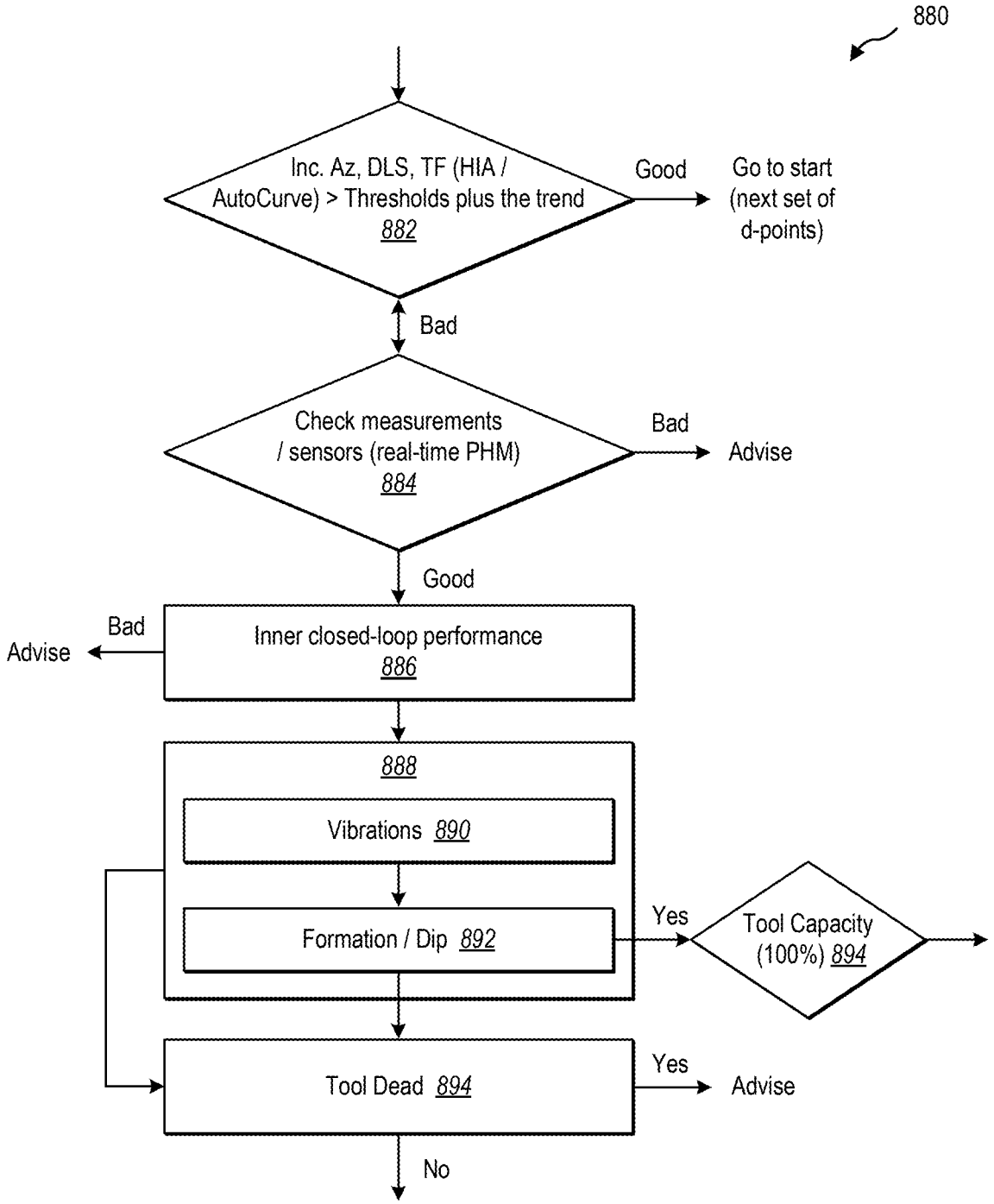
FIG. 8 is a flowchart illustrating a method of controlling a downhole tool, according to some embodiments of the present disclosure.

FIG. 8 is a flowchart illustrating a method 880 of fault detection that may be used in combination with some embodiments of the method of controlling a downhole tool described in relation to FIG. 6. For example, some embodiments of the method of controlling a downhole tool described in relation to FIG. 6 include obtaining orientation measurements (azimuth and inclination measurements) from a downhole tool in a downhole environment. The method may include comparing the orientation measurements to a threshold value (such as described in relation to FIG. 7) at 882 and, when the measured orientation measurements fall outside the threshold value, conducting a fault detection and taking at least one action based on the fault detection. In at least one embodiment, the threshold values and/or target values are at least partially corrected by the ROP ratio described herein. In some embodiments, the action is a corrected DLS demand or ROP demand. In some embodiments, the action includes notifying an operator of a system condition. In some embodiments, the action includes stopping at least a portion of the drilling system.

In some embodiments, comparing orientation measurements to threshold values at 882 includes comparing at least inclination and azimuth measurements. In some embodiments, comparing orientation measurements to threshold values at 882 includes comparing at least DLS and tool face measurements. If the orientation measurements fall within the accepted range (e.g., the first target range values described in relation to FIG. 7), no action is taken. If the orientation measurements fall outside the accepted range (e.g., outside the first target range values and/or outside the second target range values described in relation to FIG. 7), additional fault detection proceeds.

In some embodiments, the method 880 includes checking the measurements and/or sensor conditions at 884. For example, checking the measurements and/or sensor conditions may include transmitting a measurement request to one or more sensors or components of the device and verifying the results. In some embodiments, checking the measurements and/or sensor conditions includes transmitting a measurement request to one or more sensors or components of the device that measure the same property or parameter and comparing the results against one another. In some embodiments, checking the measurements and/or sensor conditions includes transmitting a self-diagnostic request to one or more sensors or components of the device that are configured to conduct and report a self-diagnostic.

If the verification and/or self-diagnostic measurements of the one or more sensors or components of the BHA fall within an accepted range, no action is taken. If the verification and/or self-diagnostic measurements of the one or more sensors or components of the BHA fall outside an accepted range, additional fault detection proceeds.

In some embodiments, the method 880 includes diagnosing system controls at 886. For example, diagnosing system controls at 886 includes testing and/or diagnosing tool face controls, velocity controls, motor controls, valve controls, and other system controls of the BHA. In some embodiments, diagnosing one or more system controls includes transmitting a self-diagnostic request to one or more sensors or components of the device that are configured to conduct and report a self-diagnostic.

If the diagnosis of the one or more system controls of the BHA fall within an accepted range, no action is taken. If the diagnosis of the one or more system controls of the BHA fall outside an accepted range, additional fault detection proceeds.

In some embodiments, the method 880 includes measuring one or more drilling dynamics properties at 888. In some embodiments, the drilling dynamics properties include vibration measurements at 890, such as via an MWD as described herein. In some embodiments, the vibration measurement is based at least partially on the ROP ratio. For example, the amount of vibration in the system may be based at least partially on a lateral deflection of the BHA. In some embodiments, the severity of the lateral deflection may be based at least partially on the ROP. The vibration measurements may be at least partially corrected based on the calculated ROP ratio, such as described in relation to FIG. 6. In some embodiments, the drilling dynamics properties include measuring stick-slip dynamics. In some embodiments, vibration measurements and/or stick-slip dynamics measurements indicate a formation change or tool degradation, such as wear on gauge surfaces, steering pads of the directional steering tool, or cutting elements of the bit.

In some embodiments, the drilling dynamics properties include formation measurements and/or environmental measurements at 892. As described herein, changes in formation composition or other formation properties can contribute to changes in orientation measurements, vibration measurements, ROP, DLS, etc. In some embodiments, the environmental measurements include formation measurement and/or changes as described in relation to FIG. 3.

In some embodiments, the method 880 includes reporting a status of a downhole tool at 894. In some embodiments, reporting the status of the tool includes reporting the status to an operator. For example, the system may transmit a notification to the operator via a display device or audio signal. In some embodiments, reporting the status of the tool includes reporting the status to a control system and changing at least one operating parameter of the tool or another portion of the drilling system. For example, the status of the directional steering tool may indicate the directional steering tool is saturated, and reporting the status of the directional steering tool may further include changing or suggesting a change to an ROP. In some embodiments, downhole diagnostics can allow the BHA to report a status of the tool with minimal communication needed and/or limit the downlink communications needed to correct a fault, further saving time.

Embodiments of the present disclosure generally relate to devices, systems, and methods for controlling a downhole tool in a downhole environment. In some embodiments, methods and systems, according to the present disclosure, include a control unit in the downhole environment receiving or detecting a communication to control at least a portion of a bottomhole assembly. In some embodiments, downlink communications to adjust drilling parameters of the downhole tool(s) slow or stop drilling operations for 5 to 30 minutes. Simplifying and/or reducing the number of downlink communications and the duration of the downlink communications from a surface controller can save significant time and money on a drill site.

In some embodiments, automated drilling routines based on one or more pre-determined stages or a pre-determined well plan can limit downhole communications and increase uptime of the drilling system. However, downhole environments are variable and the effects on the drilling system and components of the drilling system can be unexpected. Furthermore, communication with a bottomhole assembly (BHA) or other downhole components of the drill string can present a challenge when hundreds or thousands of meters from the surface controls.

In some embodiments, an automated drilling routine automatically adjusts one or more operating parameters of a downhole component, such as a directional steering tool, turbine, or mud motor to change a rate of penetration (ROP)

of a drill bit or a direction and/or radius of curvature of the borehole during drilling. For example, an automated drilling routine may target a pre-determined azimuth and/or inclination for the borehole being drilled. The directional steering tool may actuate steering pads or other features to urge the drill bit in the direction of the target azimuth and/or inclination. By acting over a period of time, a gradual curve can be created in the borehole to meet the target azimuth and/or inclination before a target location is reached and/or a target distance is drilled.

In some embodiments, the directional steering tool and/or other downhole components can measure the rotational orientation of the directional steering tool and/or other downhole components but may be uninformed of the longitudinal position of the BHA in the borehole and the actual ROP (and longitudinal speed) of the BHA and/or drill string through the formation. In the event that the directional steering tool and/or other downhole components are not changing orientation when expected (i.e., not moving through a curve), the automated drilling routine may attempt to compensate for the difference between the targeted changes and the measured changes by adjusting (e.g., increasing) a targeted dogleg severity (DLS) and/or ROP.

More particularly, some automated drilling routines include setting or changing DLS based on time and progress toward a target value or target location. The longitudinal progress through a planned stage or well plan is, in some embodiments, calculated (and not measured) in the downhole environment by a fixed estimate of the ROP stored locally on the downhole tool ("downhole ROP"). In some embodiments, the downhole ROP is stored on a surface control device to limit additional communication with the downhole tool(s). In the event that the ROP as measured by advancement of drill pipe or other segments of the drill string at the surface ("surface ROP") is not matching the downhole ROP, the downhole tool can steer the bit and/or BHA with a DLS that provides the wrong curvature and/or misses a target location. In a particular example, if the surface ROP is 50% of the downhole ROP, an automated drilling routine actuating a directional steering tool based on the downhole ROP may create an actual DLS (e.g., 2°/10 m) that is double the planned DLS (1°/10 m) according to the stage and/or well plan. In another particular example, if the surface ROP is 200% of the downhole ROP, an automated drilling routine actuating a directional steering tool based on the downhole ROP may create an actual DLS (e.g., 0.5°/10 m) that is half the planned DLS (1°/10 m) according to the stage and/or well plan.

If the drill string is not advancing (e.g., during connection of a stand, idling, rotating off-bottom, or reaming), the drilling system can continue ramping the DLS and ROP progressive more and more, causing a runaway DLS. In some examples, the directional steering tool and/or other downhole components can erroneously determine the BHA is not effectively turning through the formation when the drilling system is, in actuality, not drilling at all. In a particular instance, transmitting a conventional downlink communication to change the automated drilling routine settings and/or reset values can require a 25-minute sequence of downlink communications. In another particular instance, changing the downhole ROP of a conventional BHA requires more steps and longer communications than changing a demanded DLS value. In some embodiments, according to the present disclosure, a downlink communication includes a corrected DLS demand based on a ratio of the known downhole ROP (as stored locally on the BHA) and a measured surface ROP to effectuate a desired actual DLS. In such embodiments, the downlink communication including the corrected DLS demand is shorter and/or more reliable than a series of downlink communications to change the downhole ROP and the DLS.

In some embodiments, a drilling rig or other component of the drilling system at surface transmits a downlink communication to the control unit. In at least one embodiment, the downlink communication is a rotations-per-minute (RPM) pulse. For example, an RPM pulse can allow a downlink communication when drilling fluid (e.g., mud) flow rate and/or pressure is unreliable. In at least one embodiment, the single downlink communication is a mud pulse. For example, a mud pulse can allow a downlink communication when an RPM pulse is unreliable.

In some embodiments, such as when ratio of the known downhole ROP and a measured surface ROP ("ROP ratio") determine a corrected DLS will saturate the directional steering tool (e.g., request the directional steering tool actuate a steering pad at or beyond 100% of the actuation range), systems and methods according to the present disclosure additionally provide instructions to change an ROP of the drilling system.

For example, an ROP ratio of 0.5 (e.g., the downhole ROP is half the surface ROP) may generate a corrected DLS demand that is double the planned DLS. In other words, when the actual ROP is faster than planned, the directional steering tool applies a greater force to steer the BHA faster through a curved portion of the well plan. In such an instance, doubling the steering of the directional steering tool may saturate the directional steering tool. In some embodiments, systems and methods according to the present disclosure include determining both a corrected DLS demand (e.g., 100% steering) to be communicated downhole to the BHA and an ROP demand to adjust the surface ROP to effectuate the desired trajectory. In some embodiments, the ROP ratio is further used for fault detection when measured drilling orientation and dynamics values exceed threshold values.

In some embodiments, the BHA includes a control unit configured to receive one or more of directional information, operating conditions, environmental conditions, fluid measurements, drilling mechanics information, or other status information. In some embodiments, the control unit is in data communication with at least one sensor (e.g., an MWD including one or more sensors) and a directional steering tool. In some embodiments, the control unit is integrated with the MWD and/or the directional steering tool. The control unit includes a processor and a hardware storage device in data communication with the processor. The hardware storage device has instructions stored thereon that, when executed by the processor, cause the BHA to perform at least a portion of any method described herein.

In some embodiments, the hardware storage device has a plurality of stages and/or well plan stored thereon. In some embodiments, the well plan is loaded to the hardware storage device at the surface of the drilling system prior to running the BHA (including the control unit) downhole. In some embodiments, the well plan includes a plurality of stages of the well plan. The control unit obtains at least one of the directional information, operating conditions, environmental conditions, fluid measurements, drilling mechanics information, or other status information from one or more sensors of the BHA. In at least one example, the sensors are in or part of the MWD.

A formation measurement is, in some examples, a measurement of at least one property of the formation through which the BHA is drilling or otherwise located. For example, a formation measurement includes a formation fluid composition, a formation solids composition (e.g., geochemistry), a formation hardness, a formation porosity, a formation fluid flow rate, a formation homogeneity, etc. In some embodiments, the formation measurement is made by one or more sensors of the BHA. In some embodiments, the formation measurement is made by sensors in the drill bit. In some embodiments, the formation measurement is made by sensors in the MWD. In some embodiments, the formation measurement is made by sensors in the directional steering tool.

An environmental measurement is, in some examples, a measurement of at least one property of the downhole environment that may or may not be related to the formation through which the BHA drills or is located. For example, an environmental measurement may include temperature, pressure, or other measurements that are not formation measurements but inform the drilling system of downhole conditions. In some embodiments, the environmental measurement is made by one or more sensors of the BHA. In some embodiments, the environmental measurement is made by sensors in the drill bit. In some embodiments, the environmental measurement is made by sensors in the MWD. In some embodiments, the environmental measurement is made by sensors in the directional steering tool.

In some embodiments, the BHA uses the plurality of stages and/or well plan stored locally on the BHA to determine target values, including downhole ROP and target DLS, of automated drilling routines of the stages and/or well plan. In some embodiments, the well plan includes a plurality of stages with transitions therebetween. For example, the well plan may include a curved stage and/or a linear stage. In some embodiments, the well plan includes a plurality of curved stages and linear stages. In some embodiments, the well plan includes at least one vertical stage. In some embodiments, the well plan includes a landing stage. The directional steering tool and other components of the drill string directs the BHA and drill bit through the formation according to the inclination, azimuth, dogleg severity (DLS), rate of penetration, axial length along the stage, and other parameters of the well plan.

A curved stage is any stage of the well plan in which at least one of the inclination and the azimuth of the borehole changes along a length of the stage. In some embodiments of a curved stage, the inclination is substantially constant and the azimuth of the borehole changes. In some embodiments, both the inclination and the azimuth of the borehole changes in the curved stage.

A linear stage is any stage of the well plan in which the inclination and azimuth of the borehole remains constant along the length of the stage. In some embodiments, a linear stage is a vertical stage of the well plan in which the inclination is substantially vertical relative to a direction of gravity. For example, a vertical stage may be an initial stage from the surface. In some embodiments, a linear stage of the well plan is a directional stage in which the inclination and azimuth are substantially constant, while the inclination is non-vertical, creating a lateral net movement of the borehole along the length of the directional stage relative to the direction of gravity.

In some embodiments, the well plan includes a landing stage. In some embodiments, the landing stage is a curved stage in which the borehole attains a substantially horizontal orientation relative to the direction of gravity. In some embodiments, the landing stage is a final stage of the well plan.

In some embodiments, the inclination and/or azimuth are measured dynamically in the downhole environment by one or more components of the BHA. However, determining an accurate and/or precise ROP of the bit and/or BHA through the formation material in the downhole environment is a challenge. In some embodiments, the auto curve and/or hold inclination and azimuth (HIA) systems of the drilling system use a provided downhole ROP value that is stored locally in the BHA to determine the amount and direction of steering to achieve target values. Downlink communications to change the downhole ROP can require a series of downlink communications that interrupt drilling operations for extended periods of time.

In some embodiments, a method of surface control of a BHA in a downhole environment includes obtaining azimuth and inclination measurements from a downhole tool in a downhole environment. As described herein, the azimuth and inclination measurements may be obtained from an MWD or other sensors of the downhole tool or components in communication with the downhole tool. The method further includes obtaining a downhole ROP and downhole DLS from a downhole control unit. In some embodiments, the downhole ROP is a fixed value stored locally on a hardware storage device of the downhole control unit and/or BHA. In some embodiments, the downhole DLS is determined by the downhole control unit and/or BHA based on the measured changes in azimuth and inclination over time relative to the downhole ROP.

As described herein, the downhole ROP may not reflect the actual ROP of the drilling system, and the method further includes determining a corrected DLS demand based at least partially on a ratio of downhole ROP and surface ROP (ROP ratio). In at least one embodiment, the corrected DLS demand is downhole DLS multiplied by the ROP ratio. In one example, the ROP ratio is 1.0 (e.g., the downhole ROP is the actual ROP) and a corrected DLS demand is the same as the downhole ROP. In other words, when the BHA is actually advancing at the planned ROP, the downhole DLS is correct. In another example, the ROP ratio is 0.5 (e.g., the downhole ROP is half of the actual surface ROP) and a measured downhole DLS is 2°/10 m. The corrected DLS demand to be communicated to the control unit and/or directional steering device is 1°/10 m, as the ROP ratio indicates the BHA is advancing twice as fast as the downhole ROP estimates.

In some embodiments, the determining a corrected DLS demand based at least partially on the ROP ratio further includes obtaining or determining a saturation percentage of the directional steering tool. For example, a saturation percentage is the percentage of available actuation distance or range used by the directional steering tool to achieve a current or demanded DLS. In some embodiments, obtaining or determining a saturation percentage of the directional steering tool includes measuring a saturation status. For example, the saturation status may be a binary value reporting whether the directional steering tool is saturated or not. The corrected DLS demand may be based at least partially on the saturation percentage and/or saturation status. For example, a corrected DLS demand may saturate the directional steering tool and include an instruction to change the surface ROP to achieve a desired actual DLS when the directional steering tool is saturated.

The method includes transmitting a corrected DLS demand setting to the downhole tool based at least partially on the corrected DLS demand and the downhole ROP. In some embodiments, the corrected DLS demand is communicated downhole by a downlink communication, as described herein. For example, the downlink communication may be a mud pulse communication. In another example, the downlink communication may be an RPM pulse communication.

In some embodiments, the method further includes drilling at least a portion of a borehole with the downhole tool based at least partially on a corrected DLS demand. The method may optionally include repeating at least a portion of the method after drilling the portion of the borehole to ensure the BHA remains on target.

In some embodiments, surface monitoring and controlling the downhole tool includes determining a state or fault of the downhole tool. For example, in some embodiments, one or more of the inclination, azimuth, DLS, tool face, or other status measurements are outside of a threshold target range. In some embodiments, the target value ranges for the inclination and azimuth are the same. For example, the tolerated deviation between the measured inclination and azimuth and the target value for the inclination and azimuth may be 2°. In other embodiments, the target value ranges for the inclination and azimuth are different. For example, the tolerated deviation between the measured inclination and the target inclination may be 2°, and the tolerated deviation between the measured azimuth and the target azimuth may be 1°.

In some embodiments, the comparison of the orientation measurements is conducted against a plurality of threshold values of the target ranges allow for different levels of action, notification, or intervention. For example, the first target value range for the inclination allows up to a 2° deviation from the target value, and the first target value range for the azimuth allows up to a 0.5° deviation from the target value (with a proportional limit in combination of the inclination and azimuth errors). In some embodiments, a measurement within the first target range is considered a normal or good state, and the system continues with the existing operations. In some embodiments, a measurement outside of the first target range prompts action from the system, including a notification to an operator and/or autonomous device control. In some embodiments, the second target value range for the inclination allows up to a 4° deviation from the target value, and the second target value range for the azimuth allows up to a 1.0° deviation from the target value (with a proportional limit in combination of the inclination and azimuth errors). In some embodiments, a measurement outside of the second target range prompts a second action from the system, such as a notification to an operator, an automated intervention, a stoppage of at least a portion of the drilling system, or combination thereof.

In some embodiments, a measurement outside of the threshold values for the target range triggers a fault detection of the system. For example, a notification to an operator may include an intervention suggestion and/or an autonomous intervention may require a cause of the fault to remedy before action can be taken. In some embodiments, a method of fault detection may be used in combination with some embodiments of the method of controlling a downhole tool described herein. For example, some embodiments of the method of controlling a downhole tool described herein include obtaining orientation measurements (azimuth and inclination measurements) from a downhole tool in a downhole environment. The method may include comparing the orientation measurements to a threshold value and, when the measured orientation measurements fall outside the threshold value, conducting a fault detection and taking at least one action based on the fault detection. In at least one embodiment, the threshold values and/or target values are at least partially corrected by the ROP ratio described herein. In some embodiments, the action is a corrected DLS demand or ROP demand. In some embodiments, the action includes notifying an operator of a system condition. In some embodiments, the action includes stopping at least a portion of the drilling system.

In some embodiments, comparing orientation measurements to threshold values at 882 includes comparing at least inclination and azimuth measurements. In some embodiments, comparing orientation measurements to threshold values includes comparing at least DLS and tool face measurements. If the orientation measurements fall within the accepted range, no action is taken. If the orientation measurements fall outside the accepted range, additional fault detection proceeds.

In some embodiments, the method includes checking the measurements and/or sensor conditions. For example, checking the measurements and/or sensor conditions may include transmitting a measurement request to one or more sensors or components of the device and verifying the results. In some embodiments, checking the measurements and/or sensor conditions includes transmitting a measurement request to one or more sensors or components of the device that measure the same property or parameter and comparing the results against one another. In some embodiments, checking the measurements and/or sensor conditions includes transmitting a self-diagnostic request to one or more sensors or components of the device that are configured to conduct and report a self-diagnostic.

If the verification and/or self-diagnostic measurements of the one or more sensors or components of the BHA fall within an accepted range, no action is taken. If the verification and/or self-diagnostic measurements of the one or more sensors or components of the BHA fall outside an accepted range, additional fault detection proceeds.

In some embodiments, the method includes diagnosing system controls. For example, diagnosing system controls includes testing and/or diagnosing tool face controls, velocity controls, motor controls, valve controls, and other system controls of the BHA. In some embodiments, diagnosing one or more system controls includes transmitting a self-diagnostic request to one or more sensors or components of the device that are configured to conduct and report a self-diagnostic.

If the diagnosis of the one or more system controls of the BHA fall within an accepted range, no action is taken. If the diagnosis of the one or more system controls of the BHA fall outside an accepted range, additional fault detection proceeds.

In some embodiments, the method includes measuring one or more drilling dynamics properties. In some embodiments, the drilling dynamics properties include vibration measurements, such as via an MWD as described herein. In some embodiments, the vibration measurement is based at least partially on the ROP ratio. For example, the amount of vibration in the system may be based at least partially on a lateral deflection of the BHA. In some embodiments, the severity of the lateral deflection may be based at least partially on the ROP. The vibration measurements may be at least partially corrected based on the calculated ROP ratio, such as described herein. In some embodiments, the drilling dynamics properties include measuring stick-slip dynamics. In some embodiments, vibration measurements and/or stick-slip dynamics measurements indicate a formation change or tool degradation, such as wear on gauge surfaces, steering pads of the directional steering tool, or cutting elements of the bit.

In some embodiments, the drilling dynamics properties include environmental measurements. As described herein, changes in formation composition or other formation properties can contribute to changes in orientation measurements, vibration measurements, ROP, DLS, etc. In some embodiments, the environmental measurements include formation measurement and/or changes as described herein.

In some embodiments, the method includes reporting a status of a downhole tool. In some embodiments, reporting the status of the tool includes reporting the status to an operator. For example, the system may transmit a notification to the operator via a display device or audio signal. In some embodiments, reporting the status of the tool includes reporting the status to a control system and changing at least one operating parameter of the tool or another portion of the drilling system. For example, the status of the directional steering tool may indicate the directional steering tool is saturated, and reporting the status of the directional steering tool may further include changing or suggesting a change to an ROP. In some embodiments, downhole diagnostics can allow the BHA to report a status of the tool with minimal communication needed and/or limit the downlink communications needed to correct a fault, further saving time.

It should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein, to the extent such features are not described as being mutually exclusive. Numbers, percentages, ratios, or other values stated herein are intended to include that value, and also other values that are "about", "substantially", or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims. The described embodiments are therefore to be considered as illustrative and not restrictive, and the scope of the disclosure is indicated by the appended claims rather than by the foregoing description.

What is claimed is:

1. A method of controlling a downhole tool, the method comprising:

obtaining azimuth and inclination measurements of a borehole from the downhole tool in the borehole;

obtaining a downhole rate of penetration (ROP) and a downhole dogleg severity (DLS) from a downhole control unit of the downhole tool, wherein the downhole DLS is determined based on measured changes in the azimuth and inclination measurements over time relative to the downhole ROP;

determining a ratio of the downhole ROP to a surface ROP, wherein the surface ROP is a measurement at surface of advancement of the downhole tool;

determining a DLS demand based at least partially on the downhole DLS and the ratio of the downhole ROP to the surface ROP;

transmitting a DLS demand setting to the downhole tool based at least partially on the DLS demand; and drilling at least a portion of the borehole with the downhole tool based at least partially on the DLS demand.

2. The method of claim 1, wherein the azimuth and inclination measurements are obtained during an automated drilling routine.

3. The method of claim 1, wherein transmitting the DLS demand setting includes transmitting a mud pulse downlink.

4. The method of claim 1, wherein transmitting the DLS demand setting includes transmitting a rotations-per-minute (RPM) pulse downlink.

5. The method of claim 1, wherein obtaining the downhole ROP includes obtaining the downhole ROP from a surface control device.

6. The method of claim 1, wherein determining the DLS demand includes multiplying the downhole DLS by the ratio of the downhole ROP to the surface ROP.

7. The method of claim 1, further comprising:

measuring a saturation percentage of a directional steering tool of the downhole tool.

8. The method of claim 7, wherein measuring the saturation percentage includes measuring a saturation status.

9. The method of claim 7, further comprising:

changing the surface ROP based at least partially on the saturation percentage and the DLS demand.

10. The method of claim 9, wherein the surface ROP is determined based on the directional steering tool being at 100% saturation.

* * * * *